US005119940A

United States Patent [19]

Grindrod

[11] Patent Number: 5,119,940

[45] Date of Patent: * Jun. 9, 1992

[54] PACKAGE HAVING COLLAR ENCLOSURE

[75] Inventor: Paul E. Grindrod, Madison, Wis.

[73] Assignee: Oscar Mayer Foods Corporation, Madison, Wis.

[ * ] Notice: The portion of the term of this patent subsequent to Aug. 27, 2008 has been disclaimed.

[21] Appl. No.: 716,877

[22] Filed: Jun. 18, 1991

Related U.S. Application Data

[60] Division of Ser. No. 453,290, Dec. 22, 1989, which is a continuation-in-part of Ser. No. 99,834, Sep. 18, 1987, Pat. No. Des. 305,204, which is a continuation-in-part of Ser. No. 99,835, Sep. 18, 1987, Pat. No. Des. 305,205.

[51] Int. Cl.[5] ..... B65D 1/36; B65D 5/38

[52] U.S. Cl. ..... 206/45.31; 206/561; 206/564; 229/19; 229/87.08; 426/119; 426/120

[58] Field of Search ..... 206/45.31, 45.33, 45.34, 206/551, 561, 564, 216; 229/19, 87.06, 87.08; 426/114, 119, 120, 124, 106

[56] References Cited

U.S. PATENT DOCUMENTS

| | | | |
|---|---|---|---|
| 3,067,925 | 12/1962 | Gillam | 229/19 |
| 3,773,247 | 11/1973 | Mueller | 229/19 X |
| 4,007,828 | 2/1977 | Mayled | 229/19 |
| 4,013,798 | 3/1977 | Goltsos | 229/19 X |
| 4,058,211 | 11/1977 | Barbieri et al. | 229/19 X |
| 4,221,320 | 9/1980 | Faller | 229/19 |
| 4,574,174 | 3/1986 | McGonigle | 426/243 X |
| 4,588,078 | 5/1986 | Ferrero | 206/216 |
| 4,671,453 | 6/1987 | Cassidy | 229/40 |
| 4,674,633 | 6/1987 | Steadman | 206/491 |
| 4,821,884 | 4/1989 | Griffin et al. | 426/119 X |
| 4,836,380 | 6/1989 | Walter et al. | 206/561 |

*Primary Examiner*—Paul T. Sewell
*Assistant Examiner*—Jacob K. Ackun, Jr.
*Attorney, Agent, or Firm*—Joseph T. Harcarik

[57] ABSTRACT

A package of the type having a tray with recessed compartments for receiving food products or the like, the tray being covered by a thin flexible and preferably transparent film which seals the products in their respective compartments. The outer enclosure is formed by a stiff collar which completely encircles the tray with the sides of the collar turned downwardly and inwardly to provide frictional and resilient engagement of the collar with the sides of the tray. The collar also includes a stiff support flap which enables it to stand on end.

8 Claims, 6 Drawing Sheets

PACKAGE HAVING COLLAR ENCLOSURE

This is a division of application Ser. No. 07/453,290 filed Dec. 22, 1989 which is a continuation-in-part of U.S. application Ser. Nos. 07/099,834, filed Sep. 18, 1987, now U.S. Pat. No. D,305,204, and 07/099,835, filed Sep. 18, 1987, now U.S. Pat. No. D,305,205.

FIELD OF THE INVENTION

This invention relates to packages, and in particular it relates to a package for food or the like.

BACKGROUND OF THE INVENTION

Various packages are known for food and the like which contain the product in a form which is visible to the purchasing consumer. One such package comprises a tray having individual compartments formed therein for receiving products such as food or the like and a thin flexible film covering the tray and adhered thereto for sealing off the individual compartments. Such a tray is shown in the above-noted parent applications. Such a tray is also shown for example in the Goltsos U.S. Pat. No. 4,013,798.

However, trays of this type, without more in the way of protection, are not suitable for sale in normal commerce since they are not sufficiently strong to withstand the rigorous conditions of handling, shipping, storage and the like between the manufacturer and the ultimate retailer. Accordingly, it is necessary to provide such packages with a suitable outside enclosure.

Typically, the outside enclosure has included a box which would typically completely enclose the tray. However, such typical enclosures have certain disadvantages. First, they tend to be relatively costly. Second, if the box were completely opaque, it would lack the consumer appeal which is present when the consumer can visually inspect at least a portion of the contents within the box.

The above-noted parent applications describe a tray with an outer container which encloses the inner tray but leaves openings through the top for visual inspection of the contents within the tray.

However, there exists a continuing need for new and different packages of the type containing an outer enclosure with an inner tray.

SUMMARY OF THE INVENTION

According to the present invention, a package is provided which comprises the combination of a tray which holds food product or the like in individual compartments, the tray being sealed by an overlying flexible film, in combination with an outer enclosure in the form of a collar wrapped around the tray. This collar has the advantage of being relatively inexpensive as compared to a box while concurrently being of sufficient strength when properly positioned on the package to absorb the forces to which the package would be subjected during normal handling, shipping and storage in commerce. Also this collar is constructed and designed so as to retain its position on the package, while allowing the consumer to view the contents of the tray on both sides of the collar. Such positioning is achieved by properly designing the frictional engagement between the collar and the tray and by considering the degree of resilient engagement as between the collar and the tray.

Since the collar wraps around the tray, engaging only two parallel opposed sides of the tray, it is adaptable for trays of different sizes, wherein the larger trays would simply tend to expose a greater amount of product to be viewed by the ultimate consumer on each side of the collar.

The two parallel opposed sides may be straight; or, in an alternative embodiment the parallel sides may be indented along that portion of their length which is contacted by the collar.

In a preferred embodiment, the top of the collar is longer than the bottom of the collar while the two sides are of equal length, whereby the two sides would tend to turn inwardly from top to bottom, this turned in positioning causing the upper outer corners of the collar to resiliently engage the upper outer edges of the tray, thereby enhancing the frictional engagement between the collar and the tray so as to securely position the collar on the tray.

According to another advantageous feature of the present invention, at one of the corners where a side meets a bottom, both may extend outwardly, away from the tray for a short distance to form a straight edge which is parallel to and located immediately beneath the corner of that side and the top. In this manner, the straight line of the edge and the straight line of the top corner will form a stand, permitting the package to stand upright on that side.

The present invention also includes a carton blank having the proportions adaptable for forming a collar of the present type.

Thus, it is an object of the present invention to provide a new and improved package of the type comprising a tray with food products or the like sealed in individual compartments and an outer enclosure therefor.

It is another object of the present invention to provide a new and improved package of the present type having an outer enclosure in the form of a collar which encircles the tray to provide the necessary structural integrity for normal handling, shipping and storage in commerce.

It is still another object of the present invention to provide a new package of type described having a stiff outer collar and constructed to stand on end.

It is still another object of the present invention to provide, for a package of the type described, a carton blank adapted to form a collar therefor.

These and other objects of the present invention will become apparent from the detailed description to follow.

BRIEF DESCRIPTION OF THE DRAWINGS

Preferred embodiments of the present invention will now be described with respect to the accompanying drawings, wherein.

DETAILED DESCRIPTION OF THE PREFERRED EMBODIMENTS

Referring now to the figures, like elements are represented by like numerals throughout the several views.

Figure 1:
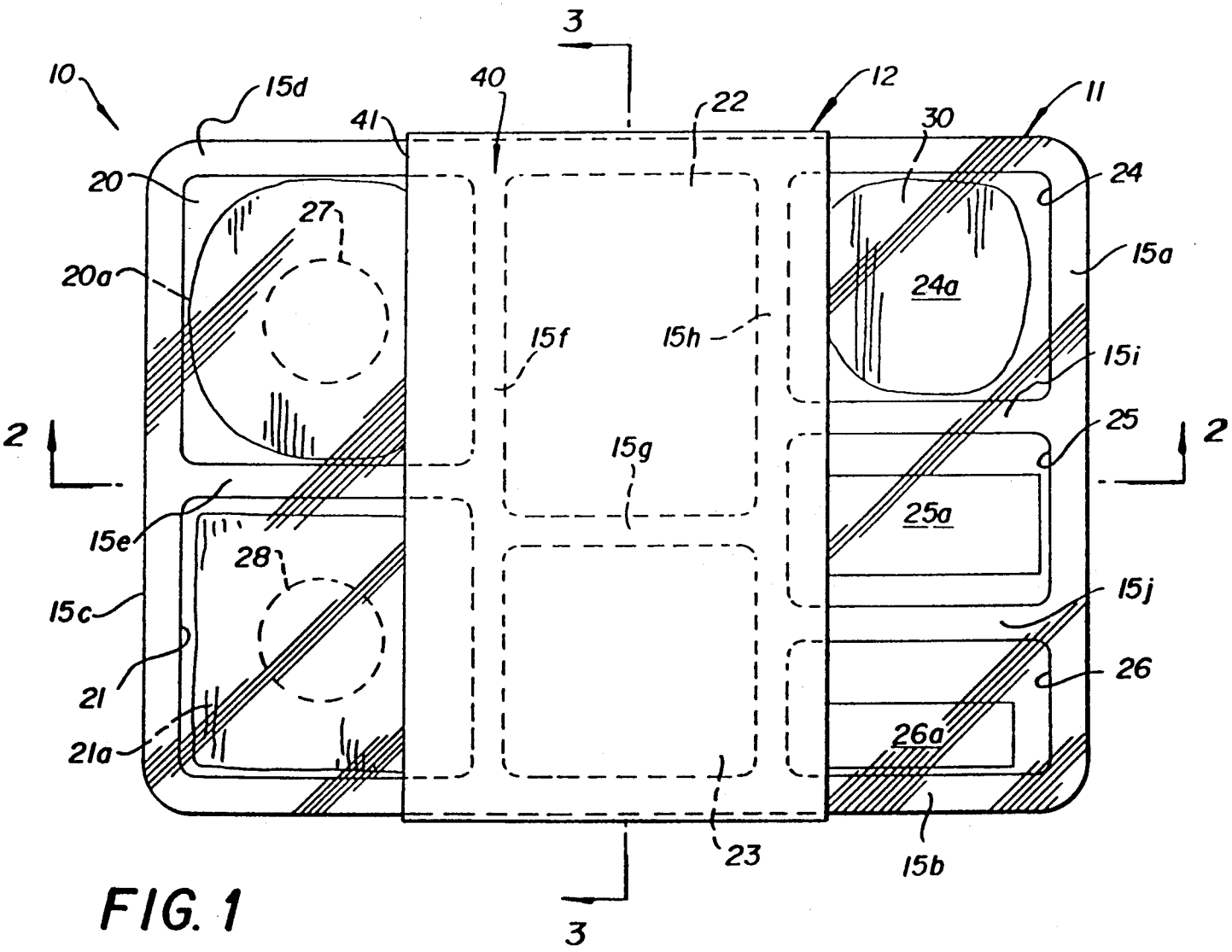
FIG. 1 is a plan view of a package according to the present invention.
Figure 2:
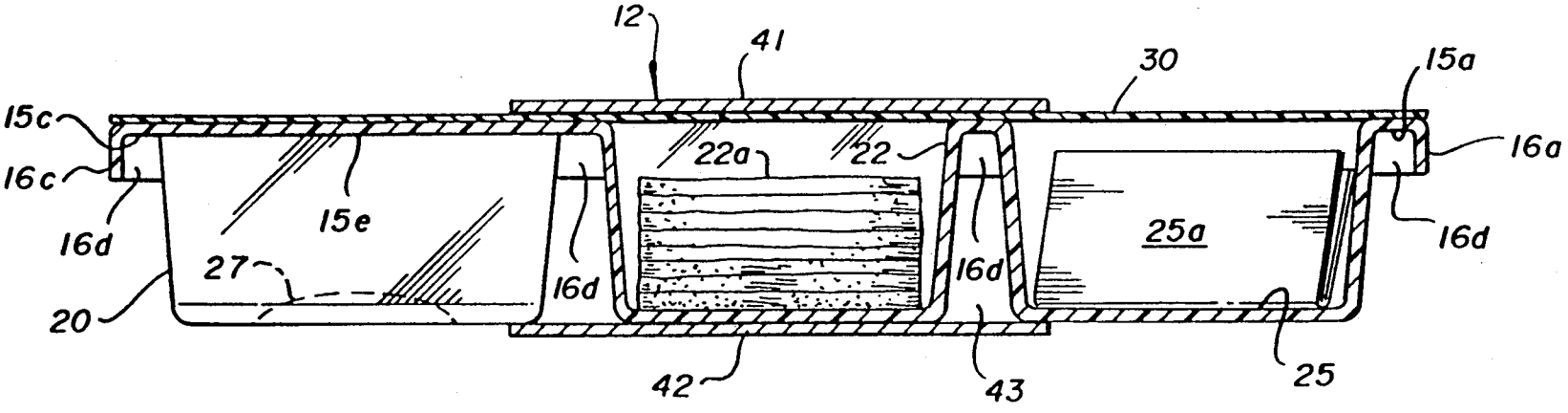
FIG. 2 is a cross sectional view taken along line 2—2 of FIG. 1.
Figure 3:
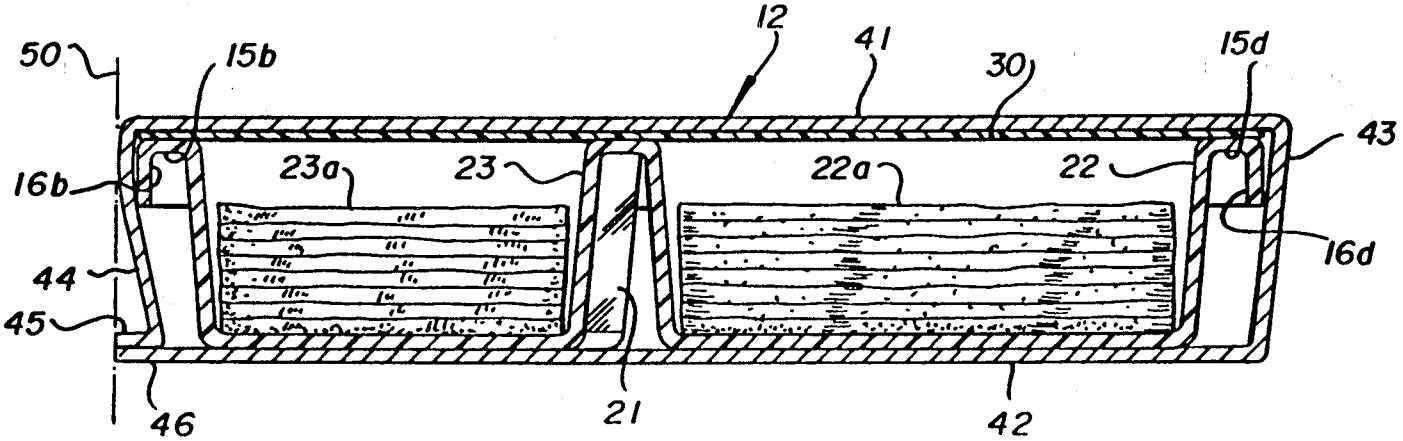
FIG. 3 is a cross sectional view taken along line 3—3 of FIG. 1.

FIGS. 1-3 illustrate a first embodiment of the present invention. As shown therein, the package 10 comprises a tray 11 which receives and preferably airtightly secures the product such as food product or the like; and this tray is encircled by a collar 12 which renders the entire package sufficiently durable for storage, shipment and handling in commerce while providing a space for printed information.

The tray is preferably formed of a single piece of plastic material, preferably made of acrylonitrile copolymers, polyesters, polypropylene, polyvinylchloride, or polyester copolymers. The tray comprises a network of flanges 15 including peripheral flanges 15*a*, 15*b*, 15*c* and 15*d* which form the outer boundary of the package and internal flanges 15*e*, 15*f*, 15*g*, 15*h*, 15*i* and 15*j* which separate the various food-containing compartments from each other. All of these flanges are located in a common plane, referred to as a reference plane. The compartments themselves are bordered on their upper edges by respective flanges and extend downwardly a sufficient distance to form a recessed compartment of sufficient depth to receive the product. The embodiment of FIGS. 1-3 includes recessed compartments 20, 21, 22, 23, 24, 25 and 26, wherein the contents therein are referred to as 20*a*, 21*a*, 22*a*, 23*a*, 24*a*, 25*a* and 26*a*, respectively. In the figures, those flanges which are beneath the preferably opaque collar 12 are shown in dotted lines but the contents of the compartments which are located beneath the collar 12 are not shown.

The preferred function of the present invention is to provide a selection of foods which, taken together, would form a snack to be eaten by a consumer at one single time. To accomplish this purpose, it is intended that the tray would actually serve as the eating utensil. To facilitate this goal, it would be preferable if all compartments were of the same depth so that the tray would sit in a stable manner on a flat surface such as a table or the like. However, it would be anticipated that some compartments would require a greater volume than other compartments. Since all compartments are the same depth, some compartments will therefore be constructed much larger than the others, taken in plan view. Also, for some compartments a relatively large length and width but a smaller depth would be preferred. For such compartments, the goal of stability is retained by maintaining the bottoms of those compartments at the same level as the other compartments but introducing a "foot" into each of those compartments which would raise the products contained therein. Such a foot is shown in the present embodiment in compartments 20 and 21 in the form of a circular raised dimple which is shown in dotted lines at 27 and 28 in compartments 20 and 21, respectively.

In a typical arrangement, a package of the present type, intended for a single snack or meal might include two selections of meats such as beef, turkey, ham, etc., two selections of crackers, two selections of cheeses, a napkin, and a small dessert item, such as candy or the like. To assure freshness, the entire tray would be covered with a thin flexible and preferably transparent film 30 which would overly the entire tray and be sealed to all of the flanges 15*a* through 15*j* so as to airtightly seal all compartments from the atmosphere and from each other. Such a film would preferably be a multi-layer film, wherein one layer is preferably polyester, nylon, polypropylene or polyethylene, while the other layer is an adhesive layer containing an antifogging additive or coating. The film may also contain an oxygen barrier such as saran ethylene vinyl alcohol. The connection between the film and the flanges of the tray would preferably be formed by heat sealing, glue or ultrasonic sealing.

The tray 11 with the contents contained therein and properly sealed by the film 30, without more, would not be of sufficient integrity for sale through normal commercial channels including packaging, shipping, handling and the like. The tray itself is not sufficiently strong and the film 30 as the sole upper boundary is too vulnerable to damage to serve as the main outer boundary in such shipping, storing, handling and the like. Also the film 30 does not provide an adequate surface for printed information. Generally, packages of this type are enclosed in an outer box. However, it is preferable, if possible, to reduce the cost of the outer enclosure. Additionally, customer appeal is substantially enhanced if portions of the contents are actually visible to the ultimate consumer.

In the present invention, this goal of providing a relatively inexpensive but appealing outer enclosure is provided by the collar 12. This collar is preferably opaque, relatively stiff and somewhat resilient, preferbly formed of paper board. The top surface 41 of this collar will generally be opaque and include most of the printed message including a trademark, a description of the product, etc. Of course this upper surface can also include openings therethrough to visually expose portions of the contents of the two middle compartments. Referring to FIGS. 2 and 3, especially FIG. 3, this collar includes a top 41, a bottom 42 and a pair of sides 43 and 44. In a preferred arrangement, the lower end of side 44 turns outwardly to form a first closing flap 45 and the bottom 42 continues to the left to form the second closing flap 46. Preferably flaps 45 and 46 are glued together to tightly secure the collar around the tray.

As noted above, the collar 12 must serve several purposes. First, it constitutes the outer enclosure and even though it covers only a portion of the package, it is sufficient to absorb the forces to which the package is subjected in the course of handling, shipment, storage and the like. Concurrently, a purpose of this package is to leave significant portions of the food product of the tray visible to enhance consumer appeal To achieve this, the collar must naturally cover only a portion of the package. However, it is important that the collar engage the package in a way which is not so tight as to damage the package but which is sufficiently tight that the collar will not slide off the package. These goals are achieved in a number of ways. First, the width of the collar, i.e. the dimension from left to right in FIG. 1 is designed, in combination with the nature of the materials which engage each other, i.e. the paperboard collar, the film 30 and the material of the tray 11 so as to provide an operable workable balance between friction and resiliency. Additionally, as shown especially in FIG. 3, the dimensions of the top, bottom and sides are so selected that they will cooperate with the dimensions of the tray to achieve this purpose. Referring to FIG. 3, the length of top 41 is such that it turns downwardly essentially at the outer edges of the upper flanges 15*b* and 15*d* such that it will not distort these upper flanges. Then, the sides 43 and 44 are turned slightly inwardly so as to frictionally engage and very slightly depress inwardly the respective skirts 16*a* and 16*d*. This in turn is accomplished by making the bottom 42 of a dimension slightly less than the top 41. For the collar to properly protect the tray and not interfere with the bottoms of the recessed compartments of the tray, it is also preferable that the lower outer corners of the collar, as viewed in FIG. 3, be spaced outwardly from the lower outer corners of the recessed compartments. Thus, in FIG. 3 a space is noted between the lower outside corners of the collar and the lower outside corners of the adjacent recessed compartments 22 and 23. In this manner, it is also assured that the collar will not abut a corner of a recessed compartment as it is slid onto the tray during the assembly process; or conversely it will more efficiently wrap around the tray if it is assembled by a wrap around rather than a sliding on technique.

Another feature of the present invention is that the single flap formed by first and second closing flaps 45 and 46 form a stiff support flap which runs parallel to the corner joining side 44 and top 41. These two parallel edges thereby form a stand which would permit the package to stand on end on a horizontal surface. Such a horizontal surface is represented in FIG. 3 by the numeral 50 upon turning this figure 90° counterclockwise. Such turning would place the top 41 facing toward the left which would be the direction from which the ultimate consumer would view the product, i.e. the consumer would then see the product, standing on end as it appears in FIG. 1. With such an arrangement, there would be exposed to the purchasing consumer not only the top 41 and the opened fronts of the recessed compartments, but also the side 43. This side 43 could then also be used for the type of printed information which would be visible to the consumer prior to purchase. Other surfaces, primarily bottom 42 but also the side 44 could be used for any other printed information, including ingredients, directions, and the like.

Figure 4:
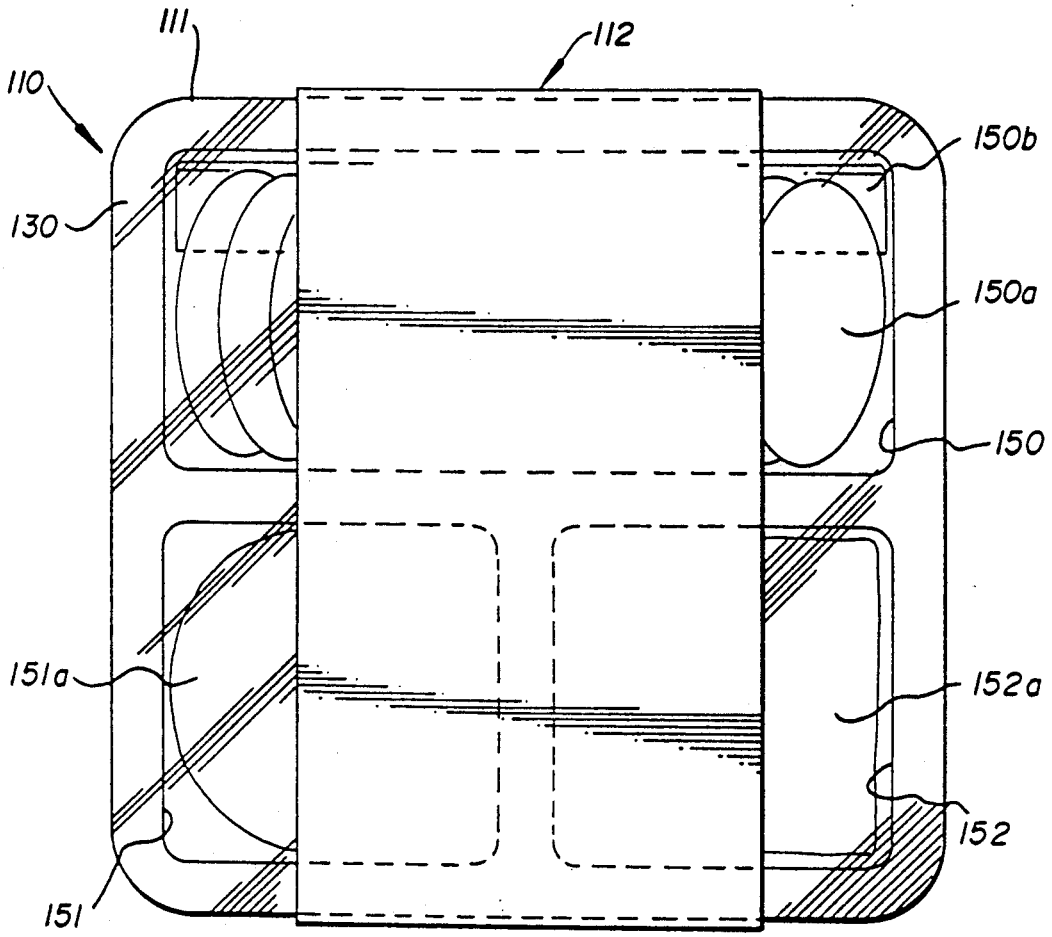
FIG. 4 is a plan view similar to FIG. 1 but showing a modification of the present invention.

FIG. 4 illustrates another preferred embodiment of the present invention. The package 110 shown therein is identical to the embodiment of FIGS. 1-3 in all respects except that it is a smaller package with a smaller number of recessed compartments. Such a package would be intended for a smaller snack or a smaller meal than the larger package shown in FIGS. 1-3. It will be understood that apart from a difference in size, all aspects of the embodiment shown in FIGS. 1-3 are applicable to the embodiment shown in FIG. 4. Therefore, such details will not be repeated with respect to FIG. 4. As shown generally in this figure, the tray 111 comprises only three compartments 150, 151 and 152.

In this smaller size package the contents of compartment 150 might include crackers 150*a* and a napkin 150*b*. The contents 151*a* and 152*a* of the other two compartments might comprise a selection of meats, cheeses, or the like.

Figure 5:
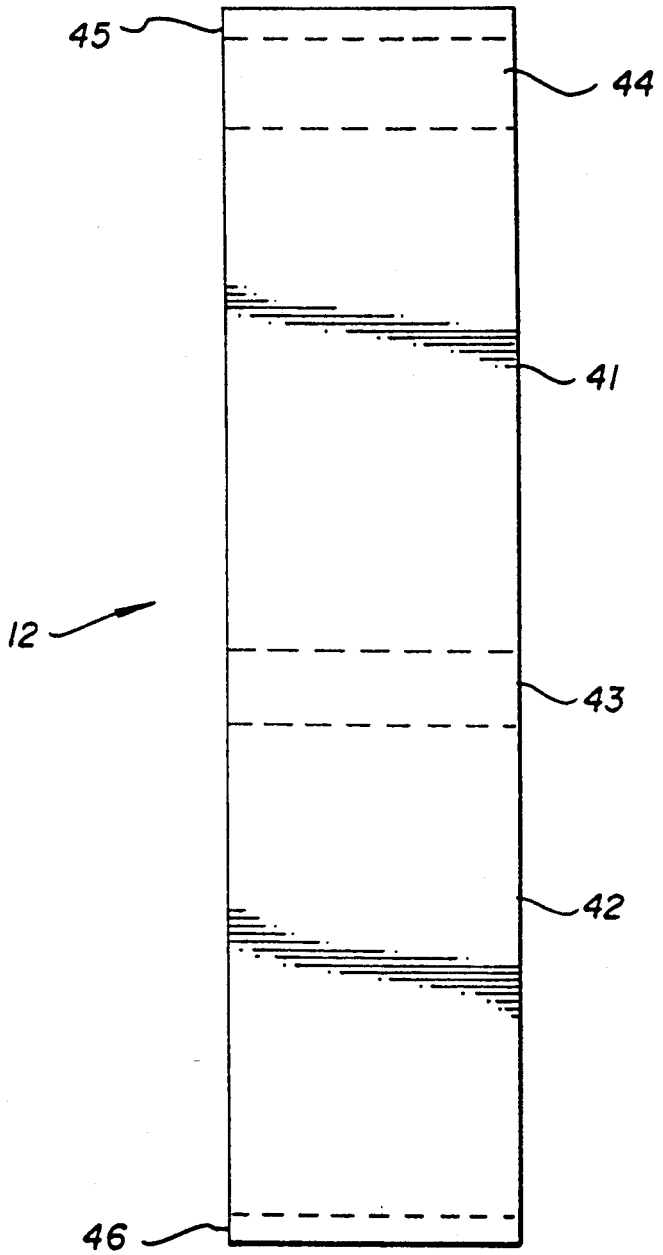
FIG. 5 is illustrates on a reduced scale a blank used to form a part of the package of FIG. 1.

FIG. 5 illustrates the collar 12 of FIGS. 1-3, unconnected and laid flat and on a reduced scale relative to FIGS. 1-3. The blank includes a plurality of panels all connected together but separated by fold lines which are shown in dotted lines. Defining the term "length" as the long direction from end to end in FIG. 5, the top panel 41 is longer than the bottom panel 42 while the two side panels 43 and 44 are of the same length. The two closing flap panels 45 and 46 are of the same length. Hence, when the collar is closed around a package with the two closing flaps 45 and 46 glued together, it will be seen that this blank will be formed into the shape of the collar 12 as shown in FIGS. 1-3 with the sides turned downwardly and inwardly toward their engagement with the bottom, thus forming the resilient engagement with skirts 16*b* and 16*d*.

Figure 6:
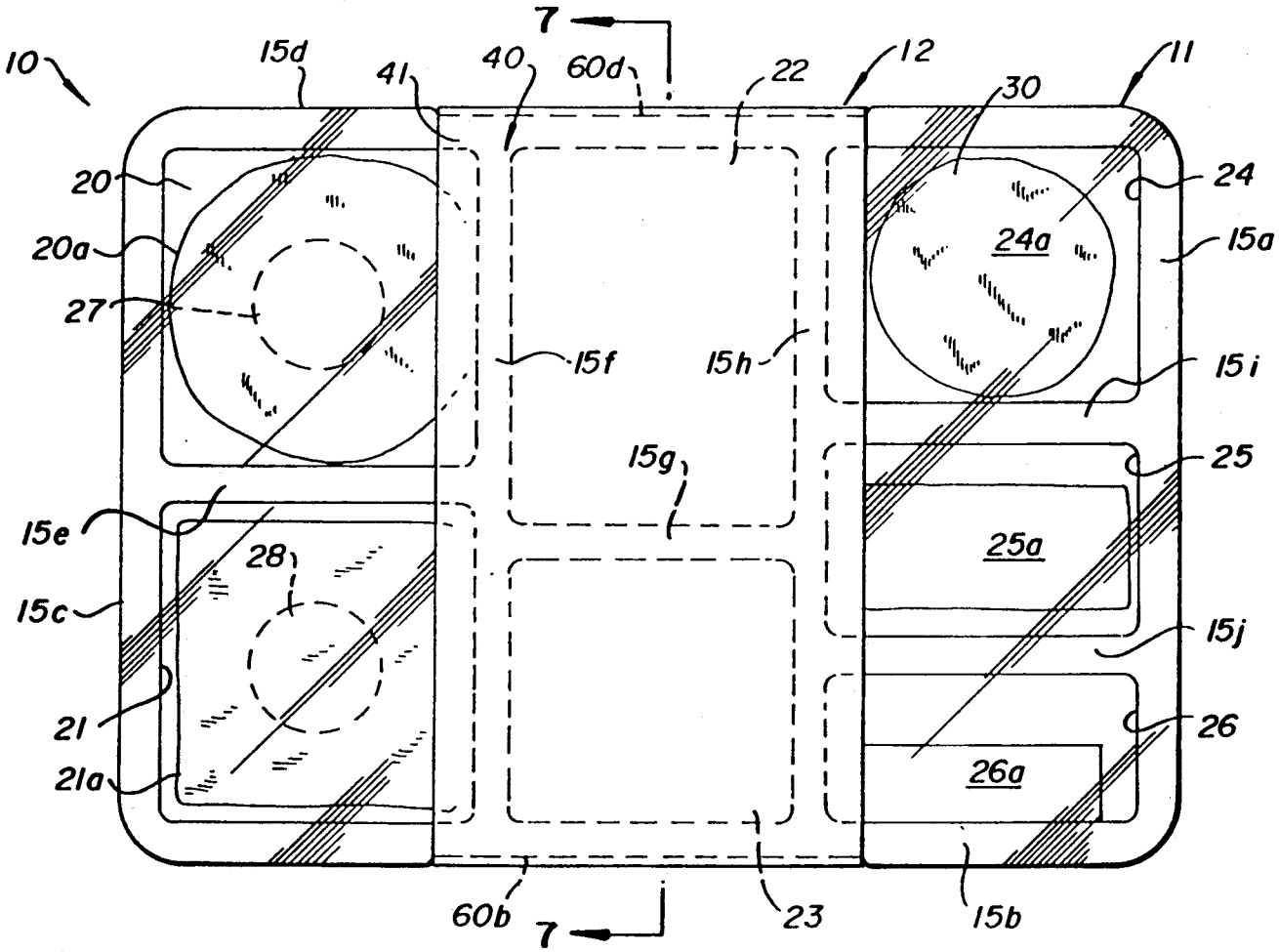
FIGS. 6 and 7 are plan and cross-sectional views similar to FIGS. 1 and 3, respectively, but showing another embodiment of the invention.
Figure 7:
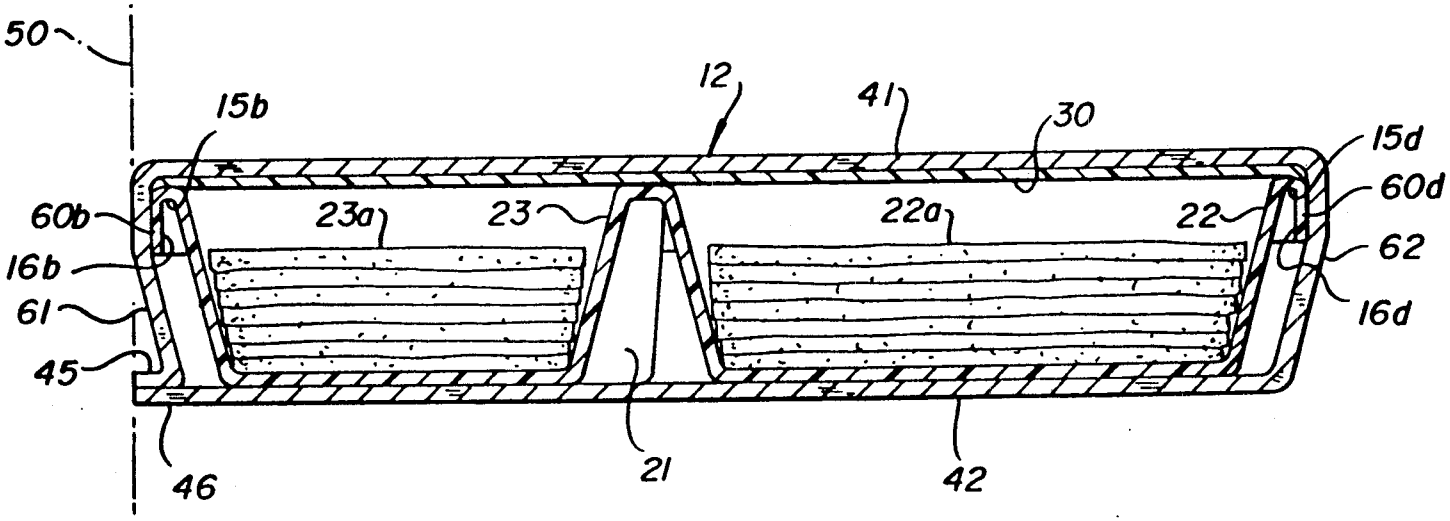

FIGS. 6 and 7 illustrate another embodiment of the invention. Elements identical to those of FIGS. 1 through 3 are designated by the same reference numerals. In this embodiment at least one, but preferably both of the peripheral flanges 15*b* and 15*d* are indented at 60*b* and 60*d* to receive the sides 61 and 62 of the collar 12. This properly positions the collar along the parallel edges without the need for frictional engagement as is required in the embodiment of FIGS. 1 through 5.

Although the invention has been described in considerable detail with respect to preferred embodiments, it will be possible that numerous modifications and variations are possible without departing from the spirit and scope of the invention.

We claim:

1. A food package, comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, and including a food product in at least some of said compartments, the tray having at least one pair of said peripheral flanges located along opposed parallel edges of the tray, the bottoms of the compartments closest to said one pair of peripheral flanges being spaced inwardly from lateral planes through the opposed parallel edges and perpendicular to said reference plane, a thin flexible transparent film covering the tray in said reference plane and attached to the flanges to airtightly seal at least some of the respective recessed compartments, a stiff collar wrapped completely around the tray, said collar including a top adjacent the reference plane, a pair of sides extending from the top towards the bottom of the tray and a bottom adjacent the bottom of the tray, portions of the sides extending inwardly towards said bottom of the collar such that at least one of said sides forms an acute angle with the top of the collar such that the two said sides, taken together, frictionally engage the opposed parallel edges of the tray, the width of the collar being less than the width of the package in the direction parallel to said opposed parallel edges, such that the food contents of at least some of the recessed compartments of the tray on both sides of the collar are visually exposed through the exposed thin flexible film, the frictional engagement between the collar and the opposed parallel edges of the tray, caused by the frictional engagement of the said sides with the opposed parallel edges, together with the width of the tray in the direction parallel to said parallel edges is such that the collar normally remains frictionally retained on the tray, and wherein the opposed pair of parallel edges include skirts connected to the peripheral flanges along those edges and extending downwardly therefrom, the engagement between said collar sides and said tray bending said skirts inwardly.

2. A food package according to claim 1, wherein the tray is essentially square, in plan view, and comprises a large rectangular recessed compartment and a pair of smaller side-by-side generally square recessed compartments, the collar being wrapped around the square tray so as to exposed opposite ends of the large rectangular recessed compartment and at least outer portions of the two smaller generally square recessed compartments.

3. A food package according to claim 1, wherein the tray is rectangular, as viewed in plan view, and comprises at least six recessed compartments arranged in at least three columns, a right column, a middle column, and a left column, and wherein the collar is wrapped around the longer edges of the tray which form said pair of opposed parallel edges and exposes at least parts of the recessed compartments of the right and left columns.

4. A food package according to claim 1, wherein the opposed parallel edges of the tray are straight.

5. A food package according to claim 1, wherein at least one of the opposed parallel edges of the tray is indented to receive the collar.

6. A food package according to claim 5, wherein both of the opposed parallel edges of the tray are indented to receive the collar.

7. A food package, comprising:

a tray formed from a single piece of resilient material having generally flat peripheral flanges located in a reference plane and defining the periphery of the tray and internal flanges also located in the reference plane, a plurality of recessed compartments, each compartment surrounded by certain ones of said flanges and extending from the reference plane downwardly to form a product receiving recess, and including a food product in at least some of said compartments, the tray having at least one pair of said peripheral flanges located along opposed parallel edges of the tray, the bottoms of the compartments closest to said one pair of peripheral flanges being spaced inwardly from lateral planes through the opposed parallel edges and perpendicular to said reference plane, a thin flexible transparent film covering the tray in said reference plane and attached to the flanges to airtightly seal at least some of the respective recessed compartments, a stiff collar wrapped completely around the tray, said collar including a top adjacent the reference plane, a pair of sides extending from the top towards the bottom of the tray and a bottom adjacent the bottom of the tray, portions of the sides extending inwardly towards said bottom of the collar such that at least one of said sides forms an acute angle with the top of the collar such that the two said sides, taken together, frictionally engage the opposed parallel edges of the tray, the width of the collar being less than the width of the package in the direction parallel to said opposed parallel edges, such that the food contents of at least some of the recessed compartments of the tray on both sides of the collar are visually exposed through the exposed thin flexible film, the frictional engagement between the collar and the opposed parallel edges of the tray, caused by the frictional engagement of the said sides with the opposed parallel edges, together with the width of the tray in the direction parallel to said parallel edges is such that the collar normally remains frictionally retained on the tray, and wherein at least one of the opposed parallel edges of the tray is indented to receive the collar.

8. A food package according to claim 7, wherein both of the opposed parallel edges of the tray are indented to receive the collar.

* * * * *